US011130213B1

(12) United States Patent
Ashenbrenner

(10) Patent No.: US 11,130,213 B1
(45) Date of Patent: Sep. 28, 2021

(54) MULTI-FUNCTIONAL UTILITY SERVICE TOOL

(71) Applicant: Daniel Ashenbrenner, Rathdrum, ID (US)

(72) Inventor: Daniel Ashenbrenner, Rathdrum, ID (US)

( * ) Notice: Subject to any disclaimer, the term of this patent is extended or adjusted under 35 U.S.C. 154(b) by 0 days.

(21) Appl. No.: 16/942,977

(22) Filed: Jul. 30, 2020

(51) Int. Cl.

| | |
|---|---|
| ***B25B 13/00*** | (2006.01) |
| ***B25B 13/48*** | (2006.01) |
| ***B25B 13/08*** | (2006.01) |
| ***B25B 13/04*** | (2006.01) |
| ***B25B 13/06*** | (2006.01) |
| ***B25B 23/00*** | (2006.01) |

(52) U.S. Cl.
CPC ..... *B25B 13/005* (2013.01); *B25B 13/04* (2013.01); *B25B 13/06* (2013.01); *B25B 13/08* (2013.01); *B25B 13/48* (2013.01); *B25B 23/0007* (2013.01)

(58) Field of Classification Search
CPC ..... B25B 13/005; B25B 13/04; B25B 13/06; B25B 13/08; B25B 13/48
USPC ..... 7/138, 165; 81/124.4
See application file for complete search history.

(56) References Cited

U.S. PATENT DOCUMENTS 4,056,020 A * 11/1977 Coviello ..... B25B 15/00 81/177.2
5,313,860 A * 5/1994 Liou ..... B25F 1/04 7/138

* cited by examiner

*Primary Examiner* — David B. Thomas
*Assistant Examiner* — Thomas Raymond Rodger
(74) *Attorney, Agent, or Firm* — Dale J. Ream

(57) ABSTRACT

A utility tool for operating a utility meter set includes an elongate body member having opposed first and second ends. A regulator cap member is coupled to a first end of the body member and defines an aperture configured to grip a regulator cap of the meter set. The regulator cap member may include first and second portions in communication with one another and configured to loosen multiple regulator cap models, respectively. A service valve member is coupled to the second end of the body member and has an offset wrench head for operating a service valve of the meter set. A pressure adjustment member is coupled to the body member intermediate the opposed ends for adjusting the regulator pressure once the regulator cap is removed. The body member defines one or more bypass apertures having a configuration complementary to that of a bypass plug associated with the meter set.

7 Claims, 10 Drawing Sheets

MULTI-FUNCTIONAL UTILITY SERVICE TOOL

BACKGROUND OF THE INVENTION

This invention relates generally to hand tools and, more particularly, to a multi-functional tool for servicing a natural gas meter set without use of or changing sizes of a traditional crescent wrench.

Utilities to a home or a business refer to the provision of water, electricity, and natural gas. A common apparatus amongst provision of these utilities is a utility meter (also referred to as a meter set). A utility meter is a metering device primarily operable to keep track of a quantity of a respective resource is used at the residential or business location over a period of time. The meter typically includes a service valve operable to allow or block a flow of the resource to the meter and house. The meter may include dials or similar readouts so that a human "meter reader" can determine usage monthly for purposes of billing. For clarity, a natural gas meter will be described further. More particularly, a natural gas meter may also include a regulator operable to alter the flow or pressure of the resource, a regulator cap which must be unscrewed and removed to give access to the regulating device, a pressure adjustment flange, and a valve bypass plug.

A utility meter, particularly a gas meter, needs to be "serviced" from time to time, such as to completely shut off the flow of gas for a reason like non-payment or the resident moving away, to adjust the pressure of gas through the regulator, and other issues of repair or maintenance. Unfortunately, each of fasteners involved have different dimensions and often become corroded and difficult or impossible to operate by hand. Accordingly, a crescent wrench is often used by a service person which must be moved to a correct size repeatedly though the service process—leading to injury, discomfort, or inefficient completion of service work.

More particularly, when using traditional methods, workers may experience physical strain in the hand, wrist, and arms over a period of time from repetitive motions involving work tasks at meter sets. The present tool will reduce the strain and repetitive motions that are experienced with adjustable wrenches, reducing fatigue and possible injuries to hand, wrist and arms. While reducing the physical exertion and strain this tool will also decrease the time it takes to complete a task, making the worker more efficient. The process of completing these tasks traditionally requires multiple tools, while this tool embodies the capacity to complete multiple tasks with just one tool/wrench.

Therefore, it would be desirable to have a multi-functional utility tool that enables a service person to do work on a natural gas meter without having to resize a crescent wrench or even to carry multiple tools to the site of a meter set in need of service work.

SUMMARY OF THE INVENTION

A utility tool for operating a utility meter set of a type having a service valve, a regulator cap, and a bypass plug, includes an elongate and linear body member having opposed first and second ends. A regulator cap member is coupled to a first end of the body member and defines an aperture configured to grip and loosen a regulator cap of the meter set. The regulator cap member may include first and second portions in communication with one another and configured to loosen multiple regulator cap models. A service valve member is coupled to the second end of the body member and has an offset wrench head for operating a service valve of the meter set. A pressure adjustment member is coupled to the body member intermediate the opposed ends and is operable to adjust the regulator pressure once the regulator cap is removed. The body member may define one or more bypass apertures having a configuration complementary to that of a bypass plug associated with the meter set.

Therefore, a general object of this invention is to provide a multi-functional utility tool that enables a service person to make adjustments to a natural gas meter without having to resize a crescent wrench or even to carry multiple tools to the site of a meter set in need of service work.

Another object of this invention is to provide a multi-functional utility tool, as aforesaid, that enables actuation of a service valve, regulator, and bypass plugs without using or readjusting traditional wrenches.

Still another object of this invention is to provide a multi-functional utility tool, as aforesaid, having more than one regulator cap tool at the same end of a body member of the tool.

Other objects and advantages of the present invention will become apparent from the following description taken in connection with the accompanying drawings, wherein is set forth by way of illustration and example, embodiments of this invention.

DESCRIPTION OF THE PREFERRED EMBODIMENT

Figure 1:
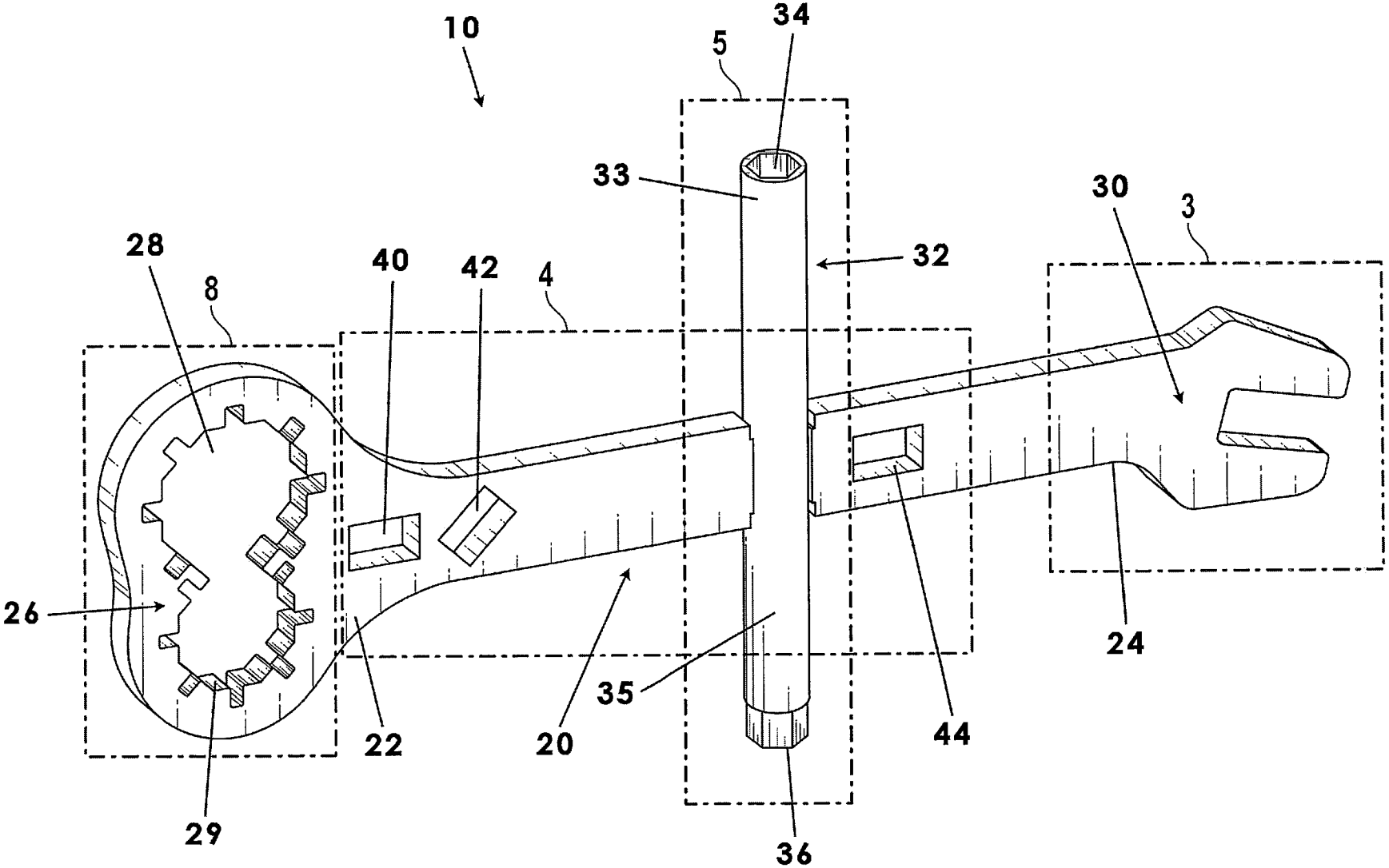
FIG. 1 is a perspective view of a multi-functional utility tool according to an embodiment of the present invention.
Figure 2:
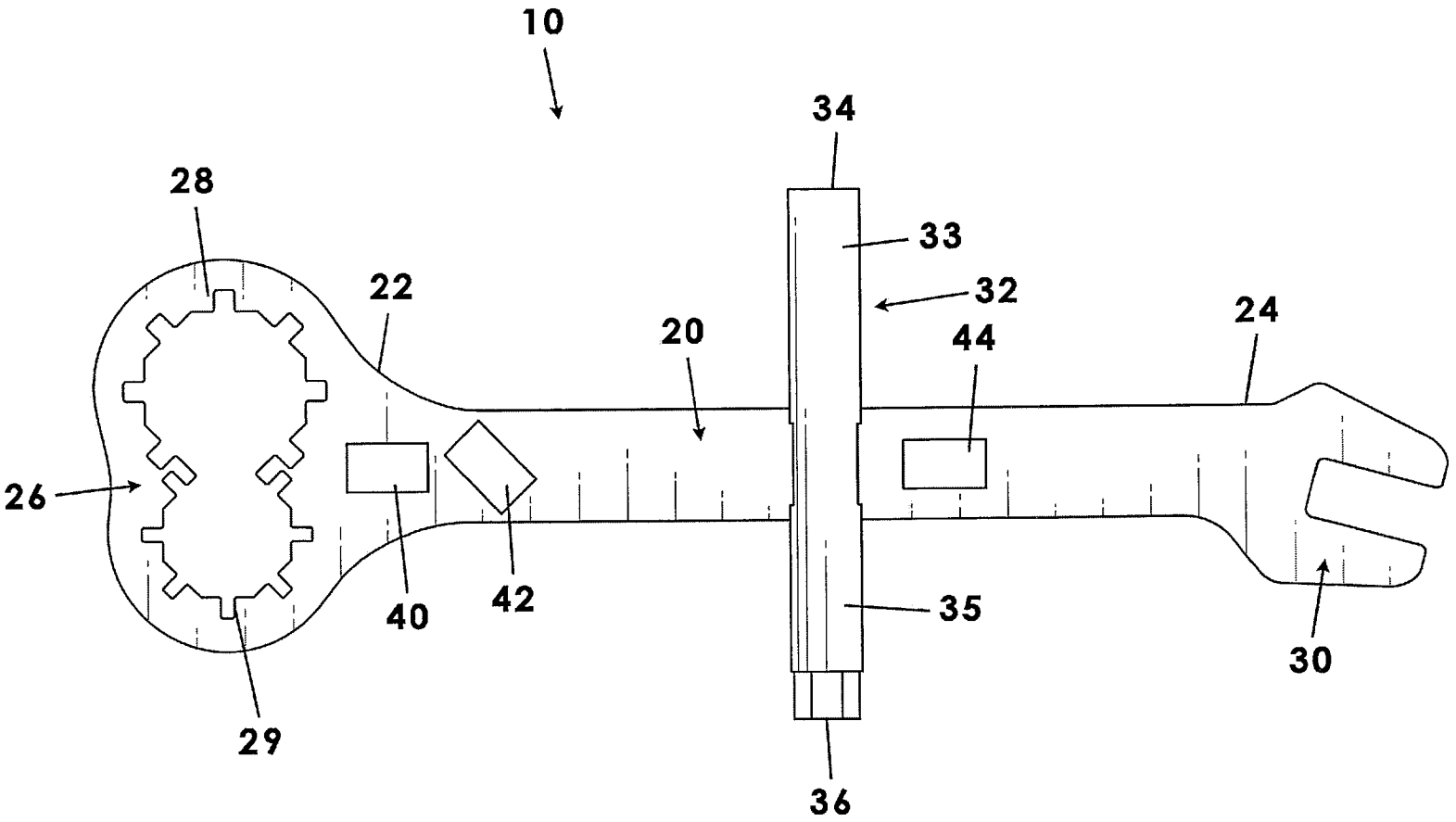
FIG. 2 is a front view of the utility tool as in FIG. 1.
Figure 3:
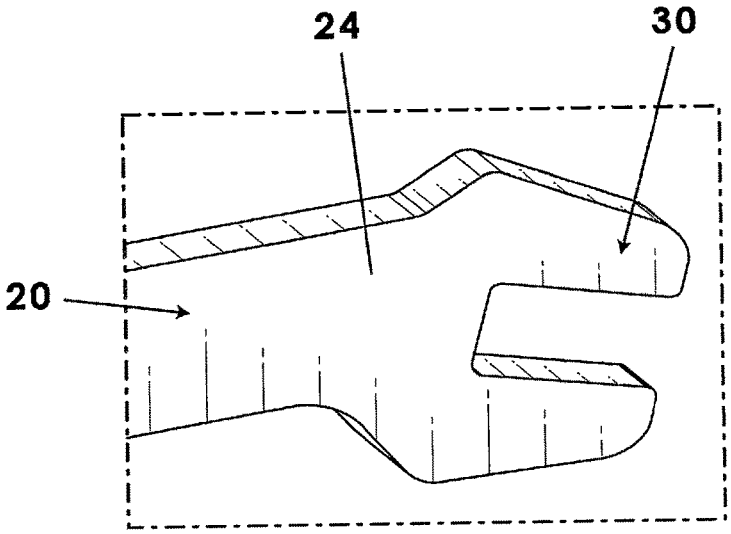
FIG. 3 is an isolated view on an enlarged scale taken from FIG. 1.
Figure 4:
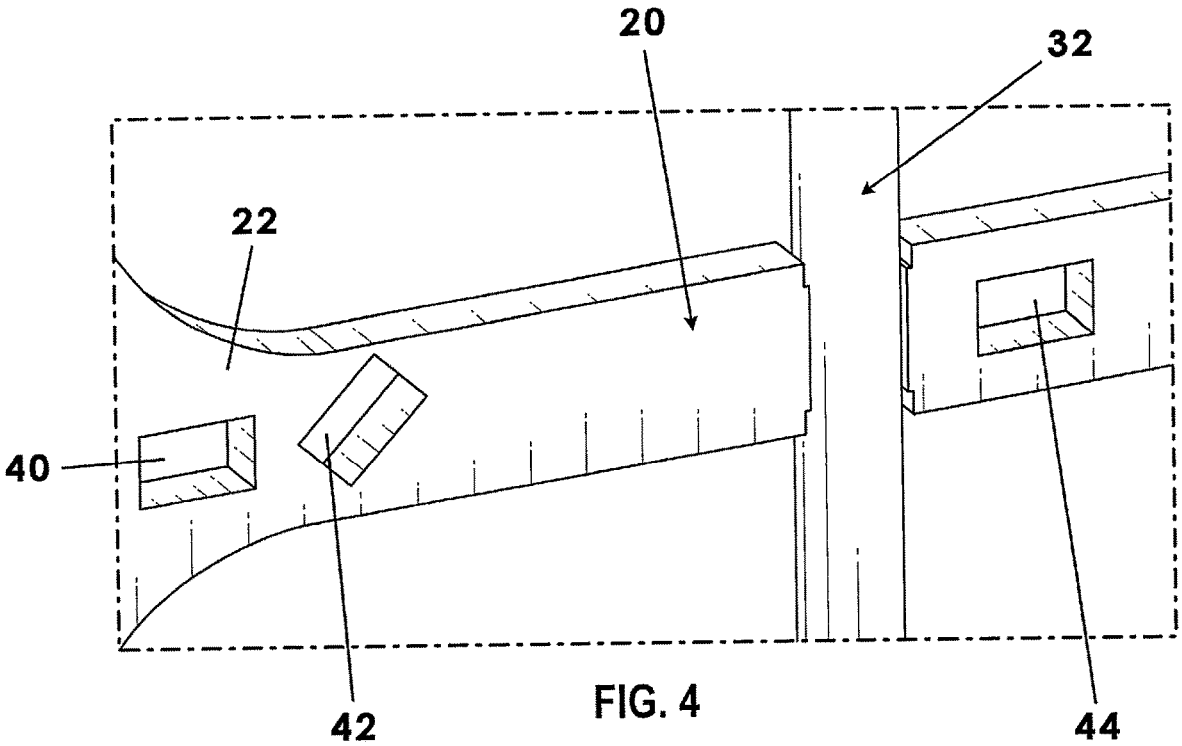
FIG. 4 is an isolated view on an enlarged scale taken from FIG. 1.
Figure 5:
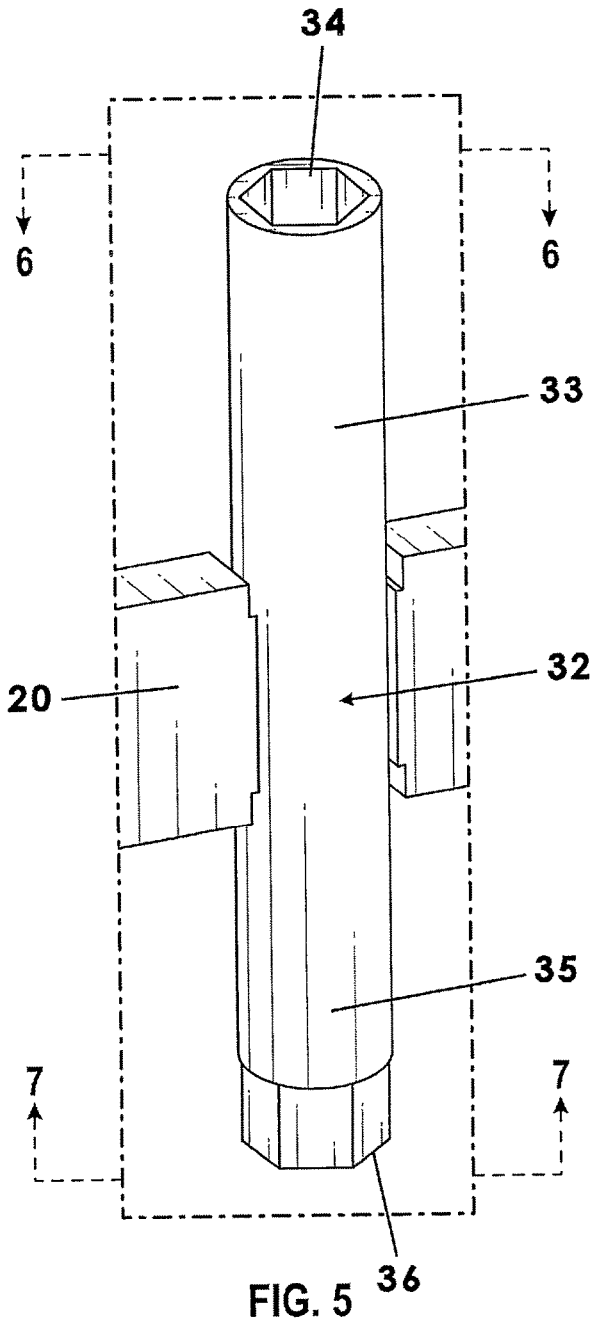
FIG. 5 is an isolated view on an enlarged scale taken from FIG. 1.
Figure 6:
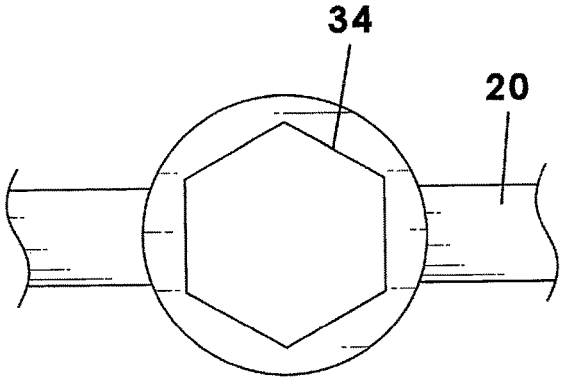
FIG. 6 is a sectional view taken along line 6-6 from FIG. 5.
Figure 7:
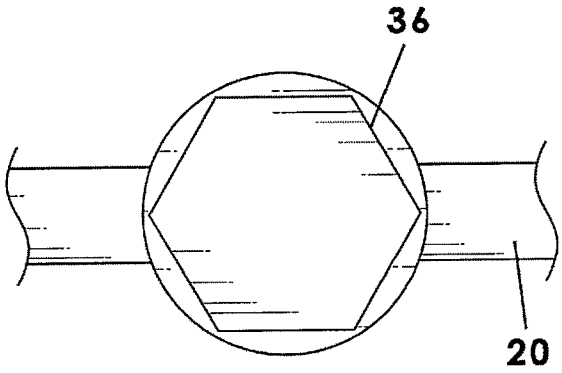
FIG. 7 is a sectional view taken along line 7-7 from FIG. 5.

A multi-functional utility service tool according to a preferred embodiment of the present invention will now be described with reference to FIGS. 1 to 14 of the accompanying drawings. The utility service tool 10 may include a body member 20, a service valve member 30, a regulator cap member 26, a pressure adjustment member 32, and at least one valve bypass aperture. The description of a traditional natural gas meter set 12 for a residential installation, as described above, is incorporated here and will be referenced with regard to the description of the multi-functional utility tool 10.

The multi-functional utility tool 10 includes a body member 20 having a thin, elongate, and linear configuration. In an embodiment, the body member 20 may be constructed of plastic and is very lightweight, especially in comparison to large stainless steel adjustable wrenches. More particularly, the body member 20 may include opposed ends that are referred to as a first end 22 and a second end 24 opposite the first end 22. The body member 20 has opposed front and back faces with a small width therebetween. Preferably, the body member 20 has a solid construction made of plastic although construction of a light metal would also work.

Figure 8:
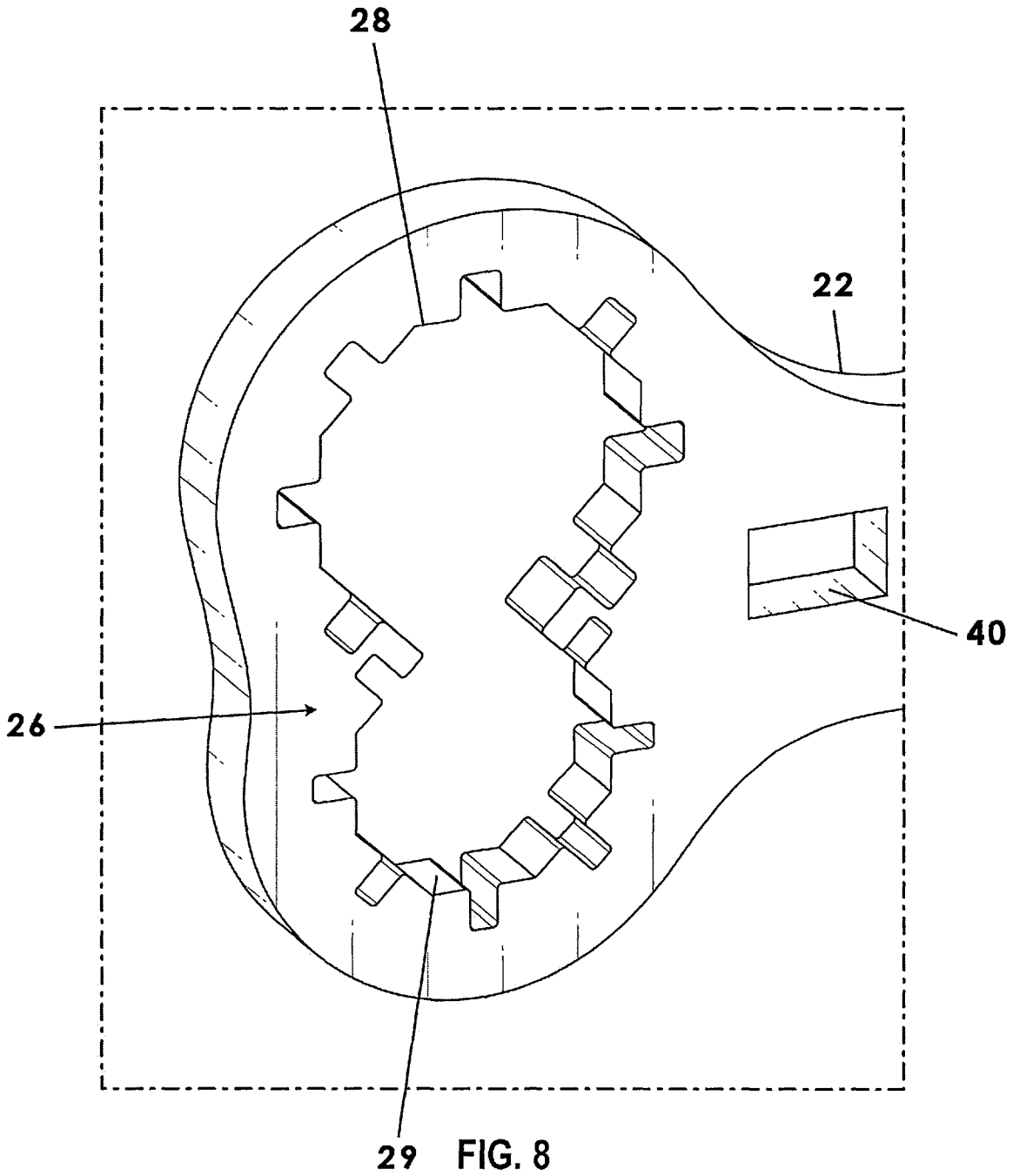
FIG. 8 is an isolated view on an enlarged scale taken from FIG. 1.
Figure 9A:
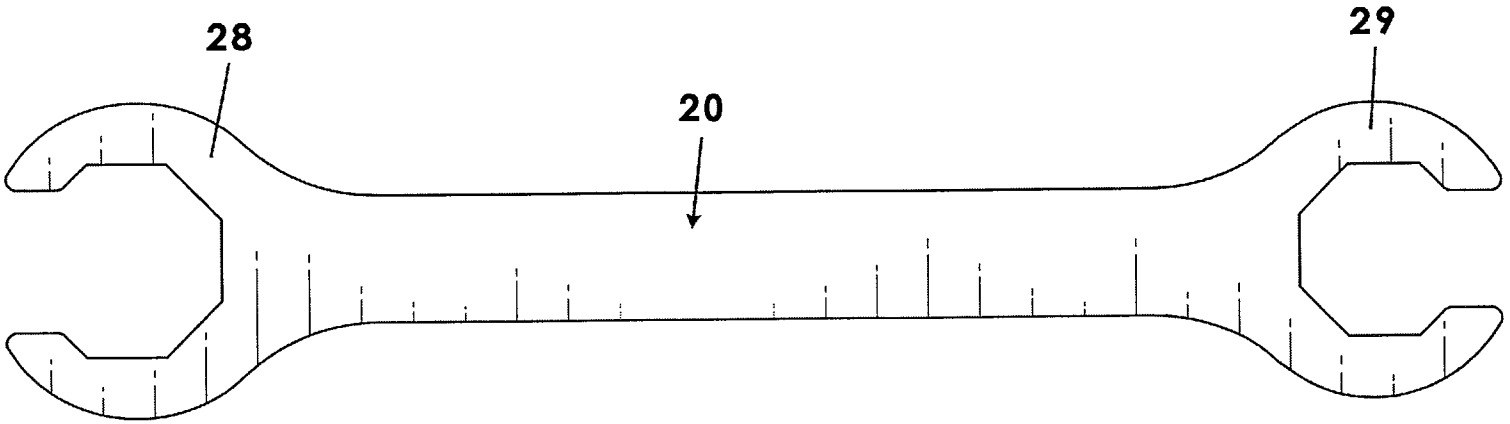
FIG. 9A is a perspective view of another embodiment of the utility tool according to an embodiment of the present invention.
Figure 9B:
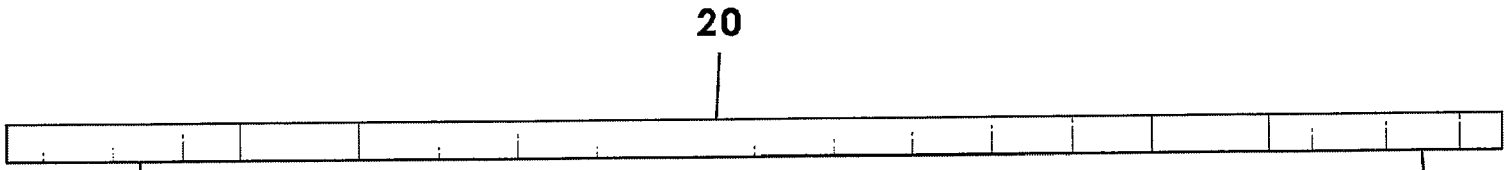
FIG. 9B is a top view of the utility tool as in FIG. 9*a;*

The utility tool 10 includes a regulator cap member 26 coupled to the first end 22 of the body member 20, the regulator cap member 26 being situated in-line along an imaginary longitudinal axis defined by the elongate configuration of the body member 20. The regulator cap member 26 is configured to engage a regulator cap 17*a* of a regulator 17 associated with the meter set 12 and, thereby, to tighten or loosen the cap. In an embodiment, the regulator cap member 26 may include a first portion 28 defining an aperture that will be referred to as having or defining a first regulator cap pattern. More particularly, the first regulator cap pattern may have a first diameter and include a plurality of spaced apart teeth or notches particularly associated with a specific regulator used in the industry, such as an 1813C regulator. Further, the regulator cap member 26 may include a second portion 29 defining an aperture that will be referred to as having or defining a second regulator cap pattern. More particularly, the second regulator cap pattern may have a second diameter and include a plurality of spaced apart teeth or notches particularly associated with a specific regulator used in the industry, such as a 143 regulator. In an embodiment, the first diameter of the first portion 28 is different (smaller or larger) than the second diameter of the second portion 29. Further, the first portion 28 may be "in communication" with the second portion 29. In other words, a respective portion may actually have a C-shaped configuration arranged such that open edge of each portion overlap or are shared by the adjacent portion as shown in FIGS. 1 and 8. Stated another way, the respective apertures may share a surface operable to connect to a respective regulator. The described structure is advantageous for a service person as the utility tool 10 may be used regardless of whether an encountered meter set includes a 143 regulator cap or 1813 regulator cap.

The utility tool 10 includes a service valve member 30 coupled to the second end 24 of the body member 20, the service valve member 30 being configured to engage or interface with a service valve 16 of the gas meter set. It is understood that the service valve is typically in-line in the piping upstream of the meter itself (i.e. the inlet conduit 14 and essentially opens or closes the pipe to allow or stop the flow of gas when actuated. More particularly, the service valve member 30 is a wrench head having a pair of laterally spaced apart legs or prongs that are parallel to one another in an arrangement operable to engage a nut, flange, or the like.

Further, the service valve member 30 may be offset relative to the longitudinal axis defined by the elongate body member 20. In other words, the wrench head may be rotated as much as 45 degrees so that the utility tool 10 is ergonomic and comfortable in use.

In another aspect, the utility tool 10 includes the pressure adjustment member 32, the pressure adjustment member 32 being coupled to the body member 20 at a position intermediate the first end 22 and second end 24. Preferably, the pressure adjustment member 32 includes a housing or continuous side wall having a cylindrical configuration, the pressure adjustment member 32 defining an interior area and opposed open ends. In other words, the pressure adjustment member 32 is hollow. Now, more particularly, the pressure adjustment member 32 may be perpendicular to the imaginary longitudinal axis of the body member 20 and is preferably situated about midway between the first end 22 and the second end 24 of the body member 20. Even more specifically, the pressure adjustment member 32 may include an upper portion 33 defining a first open end 34 that defines a first pressure adjustment pattern that is complementary to and associated with the first regulator cap pattern described above. In other words, the first open end 34 is associated with the first regulator cap pattern described above. Similarly, the pressure adjustment member 32 may include a lower portion 35 defining a second open end 36 that forms a second pressure adjustment pattern that is complementary to and associated with the second regulator cap pattern described above. Stated another, if the first portion 28 of the regulator cap member 26 was used to remove a respective regulator cap, then the first open end 34 of the pressure adjustment member 32 is sized to engage a pressure flange to adjust pressure by that associated regulator. By contrast, if the second portion 29 of the regulator cap member 26 was used to remove a respective regulator cap, then the second open end 36 of the pressure adjustment member 32 is sized to engage a pressure flange to adjust pressure by that respective regulator.

It is understood that natural gas normally flows through a meter 13 and then into the customer's home. However, bypass valves and corresponding piping allow natural gas to flow directly into the customer's home by bypassing the meter altogether—necessary to allow a meter to be replaced or serviced without disrupting the flow of gas to the customer (which would extinguish pilot lights, etc.). This is especially important in cold weather environments where it would be disadvantageous to stop a customer's furnace from generating heat. For the sake of context, it is understood that a respective meter set 12 may include a single bypass valve situated on the outlet conduit (i.e. the piping that leads from a meter to a customer's home. This valve may be connected to an auxiliary tank (not shown) of natural gas via a hose so that gas continues to be fed into a home even if the meter itself is removed for servicing. In other settings, the meter set 12 may include a bypass bar having a bypass plug/valve at either end and which may be set to enable natural gas to flow from the inlet conduit 14 to the outlet conduit 15 while completely bypassing the meter 13—again, enabling the meter to be removed and replaced.

In this aspect, the body member 20 defines at least one bypass aperture but, preferably a plurality of bypass apertures, by which the utility tool 10 may be used to interface with and actuate a respective bypass plug 18 associated with the meter set 12. Specifically, the body member 20 defines a first bypass aperture 40 adjacent to said first end 22 of the body member 20 and having a first orientation. The first bypass aperture 40 may have a configuration that is complementary to the bypass plug 18 associated with the utility meter 13. For instance, the first bypass aperture 40 may have a square shaped configuration for interfacing with an actuating a bypass plug 18 having a square configuration. It is understood that the bypass plug and associated first bypass aperture 40 may alternately have a rectangular, circular, or some other configuration (which may vary in different brands).

In recognition that a meter set 12 may be too close to a residence wall or may be blocked by other items, the body member 20 may define additional bypass valve apertures. For instance, the body member 20 may define a second bypass aperture 42 having a configuration that is complementary to a bypass plug associated with the meter. In an embodiment, the second bypass aperture 42 is adjacent the first bypass aperture 40 but is offset (i.e. rotated) relative to the first bypass aperture 40. In other words, the second bypass aperture 42 may be offset in case the bypass plug 18 itself is offset or is otherwise difficult to interface with.

Still further, the body member 20 may define a third bypass aperture 44 having a configuration that is complementary to a bypass plug associated with the meter 13. In an embodiment, the third bypass aperture 44 may be displaced away from the first bypass aperture 40 and second bypass aperture 42. Specifically, the third bypass aperture 44 may be situated adjacent the pressure adjustment member 32 and even positioned adjacent a side of the pressure adjustment member 32 opposite the first bypass aperture 40 and second bypass aperture 42. In an embodiment, the third bypass aperture 44 has the same shape configuration and orientation as the first bypass aperture 40. Again, the position and inclusion of the third bypass aperture 44 is critical due to unique and often difficult position of a bypass plug on a meter set 12.

Minor variations of the multi-functional utility tool 10 are contemplated and are shown in FIGS. 9A to 11 of the accompanying drawings. It is understood that specific utility companies may utilize specific brands of components used in a meter set 12 and desire certain combinations of the tools described above. For instance, the two portions 28, 29 of the regulator cap member 26 may be situated at opposite end of the body member 20 (rather than integrated at a single end as first described above. It is noted that the same numbers are used to describe similar features in the referenced drawings.

Figure 10:
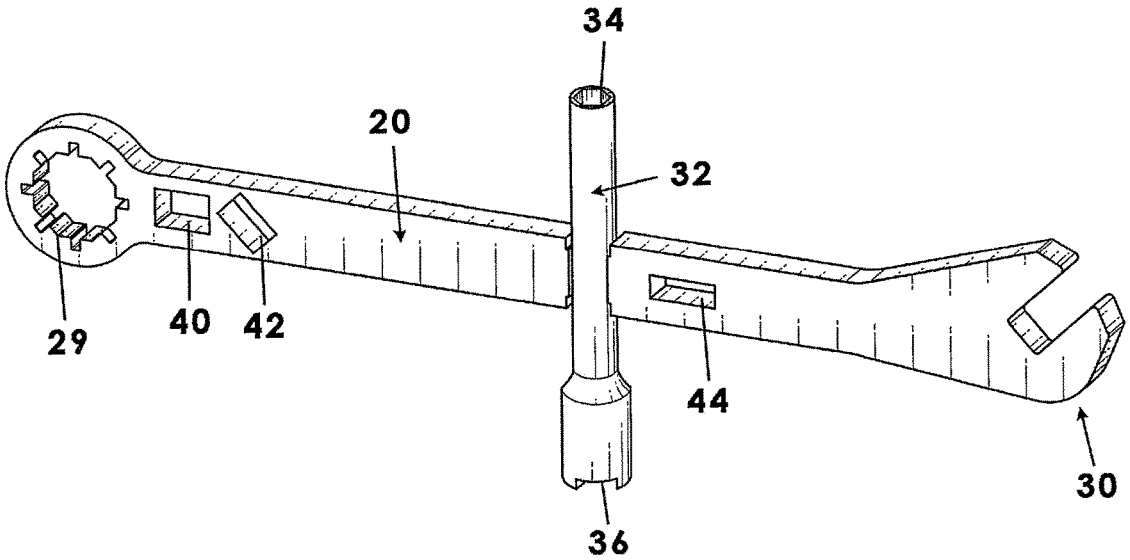
FIG. 10 is a perspective view of another embodiment of the utility tool according to an embodiment of the present invention.
Figure 11:
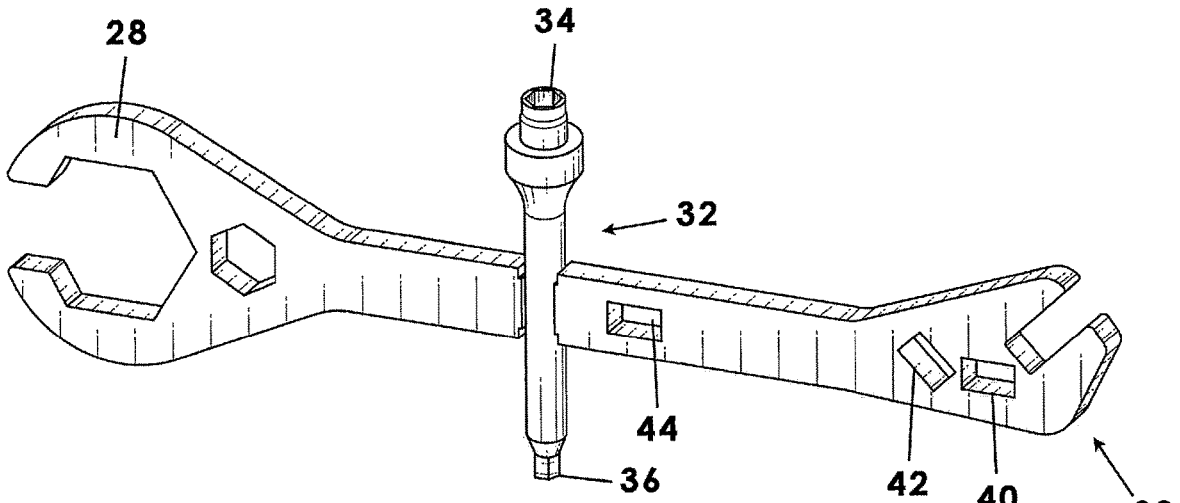
FIG. 11 is a perspective view of another embodiment of the utility tool according to an embodiment of the present invention.
Figure 12:
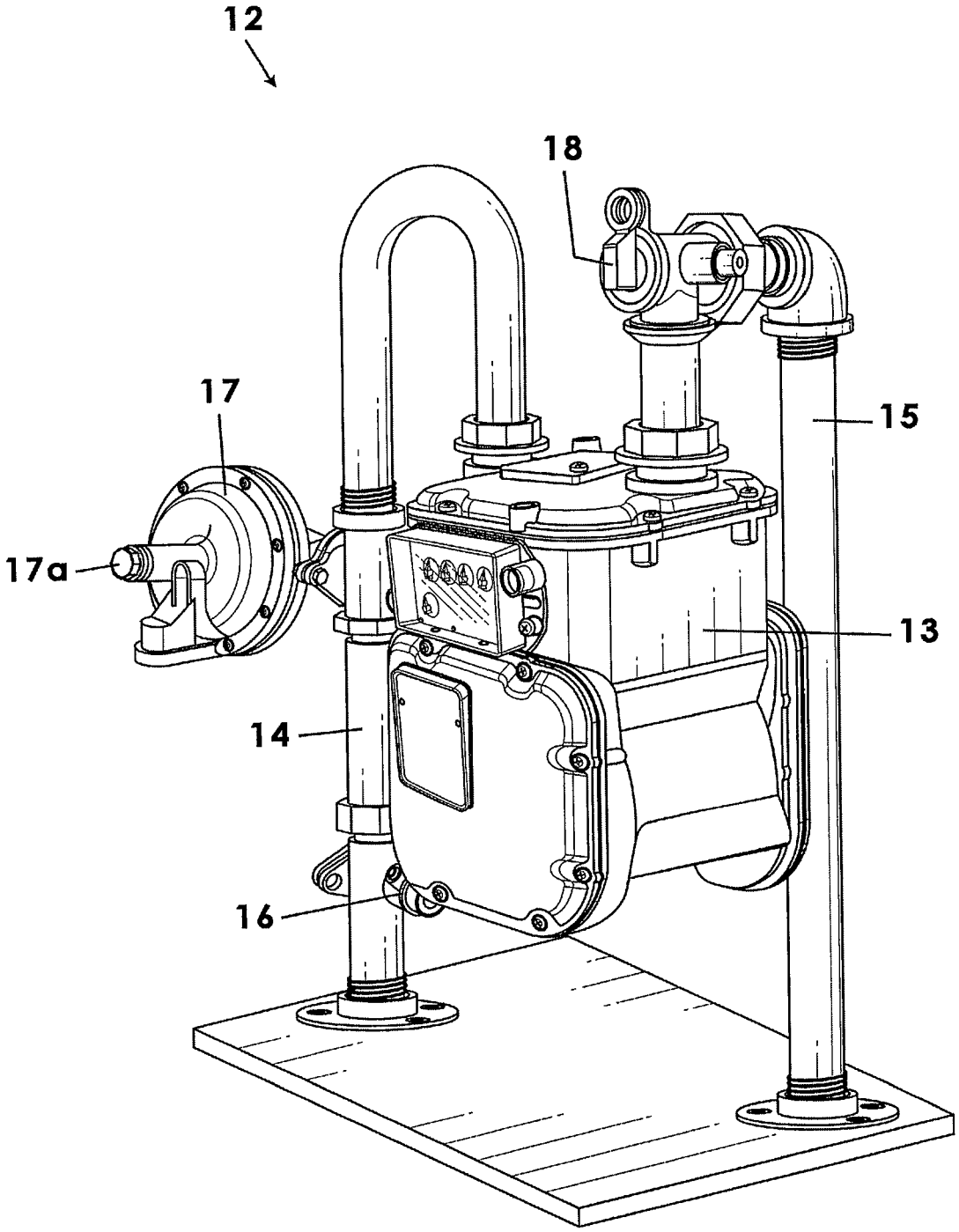
FIG. 12 is a perspective view of a meter set for use with the present invention.
Figure 13:
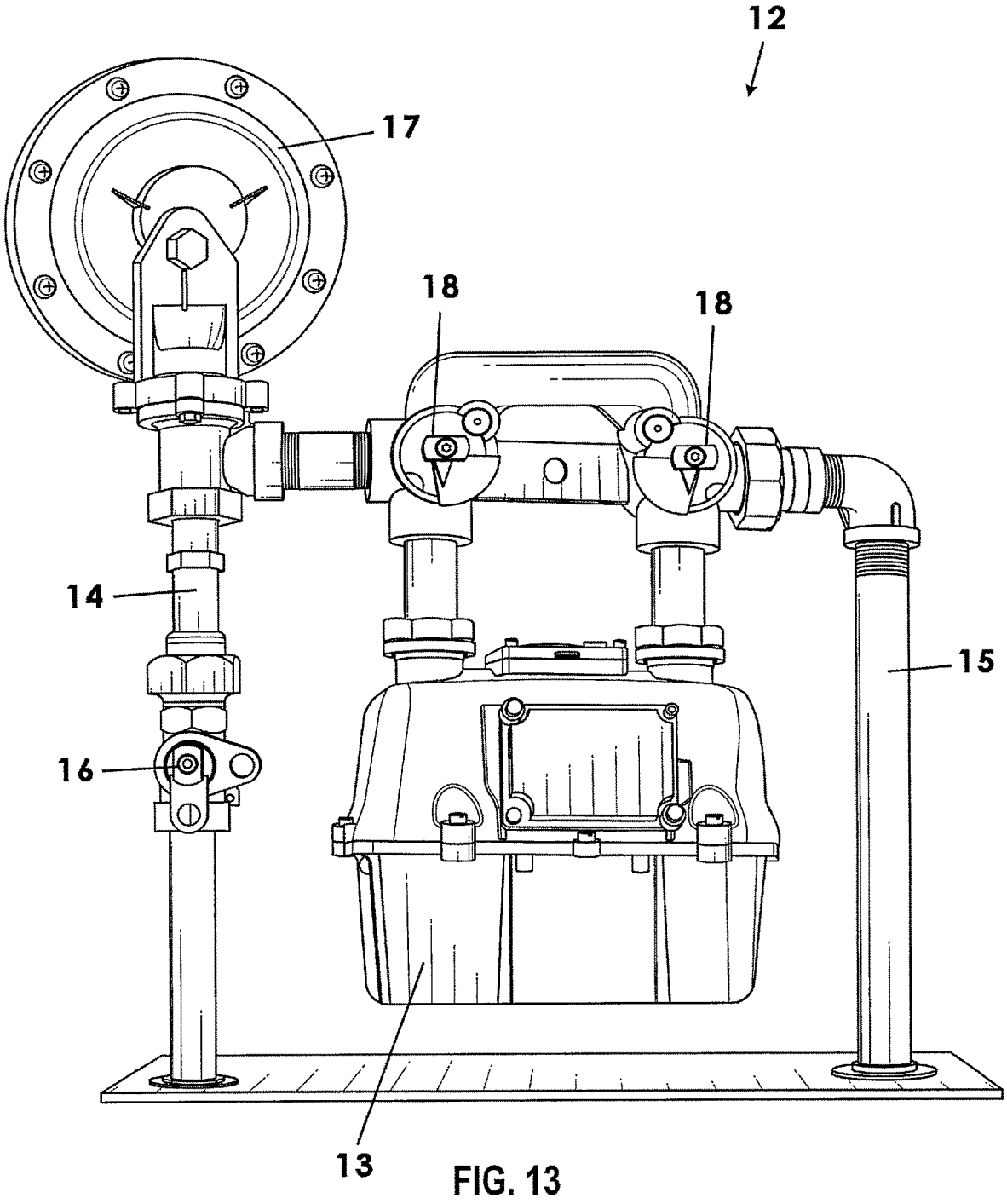
FIG. 13 is a perspective view of another meter set for use with the present invention.
Figure 14:
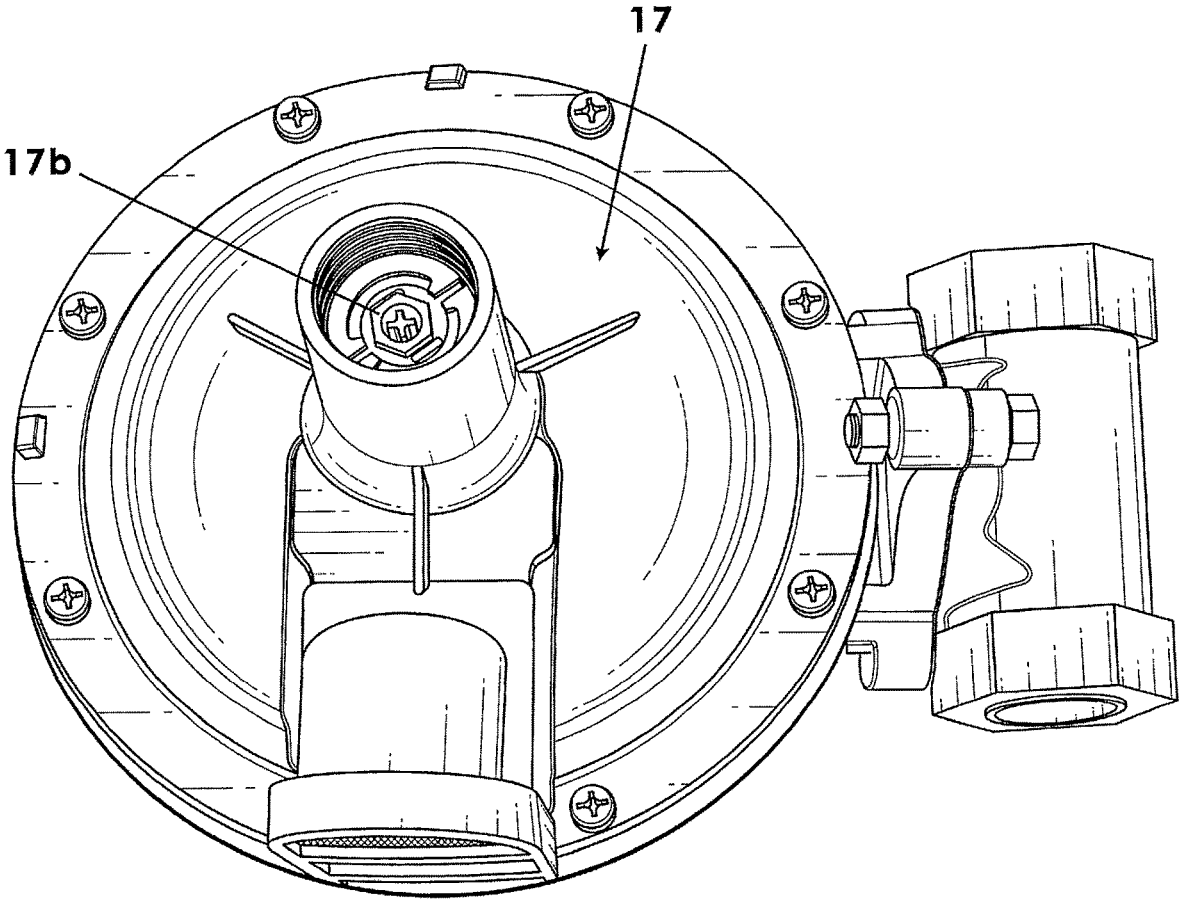
FIG. 14 is a perspective view illustrating a pressure adjustment flange of a regulator according to the present invention.

Similarly, another embodiment of the multi-functional utility tool 10 may include a regulator cap member of one type (see reference numerals 28 and 29 and contrast FIG. 10 and FIG. 11, respectively). Further, in some embodiments, the open ends 34 and 36 of the pressure adjustment member 32 may include different configurations or dimensions than first described herein. Finally, the positions of bypass apertures 40, 42, and 44 may be modified.

In use, a natural gas service person may approach a meter set 12 with only the multi-functional utility tool 10 and, importantly, without the large and heavy crescent wrench which would require repeated and tiresome readjustments while carrying out various servicing tasks. Specifically, the service valve member 30 may be used to close and later open a service valve 16, e.g. to stop the flow of gas to the meter 13 during the servicing event. Further, the regulator cap 17*a* associated with the meter set 12 may be loosened using the regulator cap member 26 of the utility tool 10—as opposed to making a re-sizing adjustment to a crescent wrench to perform this task. Further, the pressure of the regulator may be checked and adjusted using the pressure adjustment member 32 of the utility tool 10 and without bringing a separate tool from the service person's toolbox to do this. Finally, the bypass plug(s) may be operated using a respective bypass aperture of the utility tool 10 as opposed to again readjusting a crescent wrench for this purpose.

It is understood that while certain forms of this invention have been illustrated and described, it is not limited thereto except insofar as such limitations are included in the following claims and allowable functional equivalents thereof.

The invention claimed is:

1. A utility tool for operating a natural gas meter of a type that includes a regulator cap having at least one flange along a peripheral edge of the regulator cap, said utility tool, comprising:

a body member having a first end and a second end opposite said first end, said body member having an elongate and linear configuration;

a regulator cap member coupled to said first end of said body member and that is configured to interface with the regulator cap associated with the natural gas meter;

wherein said regulator cap member includes a first portion defining a first aperture complementary to a first regulator cap pattern and said first aperture having a first open side, said regulator cap including a second portion defining a second aperture complementary to a second regulator cap pattern and defining a second open side;

wherein said first portion open side and said second open side have a unitary construction and are proximate said first end of said body member;

wherein said first open side is in fluid communication with said second open side;

wherein said first aperture of said first portion defines a diameter that is different than a diameter defined by said second aperture of said second portion;

a service valve member coupled to said second end of said body member and that is configured to interface with a service valve associated with the natural gas meter;

wherein said service valve member includes a bifurcated wrench head coupled to and extending from said second end of said body member and includes a pair of prongs displaced from and parallel to one another so as to engage the service valve of the utility meter, said second end being angularly offset from a longitudinal axis defined by said body member; and a pressure adjustment member coupled to said body member intermediate said first end and said second end;

wherein said pressure adjustment member includes a housing having an elongate and cylindrical outer configuration and defining an interior area, said pressure adjustment member having (1) a first open end defining a first pressure adjustment pattern having a fixed and hexagonal-shaped configuration associated with said first regulator cap pattern and having (2) a second open end defining a second pressure adjustment pattern having a fixed and hexagonal-shaped configuration associated with said second regulator cap pattern;

wherein said first open end includes a diameter different than a diameter of said second open end;

wherein said body member defines a first bypass aperture adjacent to said first end and having a first orientation;

wherein said body member defines a second bypass aperture having a second orientation that is rotationally offset about 45 degrees relative to said first bypass aperture.

2. The utility tool as in claim 1, wherein said body member includes a third bypass aperture displaced from said first and second bypass apertures.

3. The utility tool as in claim 2, wherein said third bypass aperture is positioned adjacent to said pressure adjustment member and downstream of said pressure adjustment member relative to said first and second pressure bypass apertures.

4. A utility tool for operating a natural gas meter of a type that includes a regulator cap having a plurality of flanges spaced apart along a peripheral edge of the regulator cap, said utility tool, comprising:

a body member having a first end and a second end opposite said first end, said body member having an elongate and linear configuration;

a regulator cap member coupled to said first end of said body member and that is configured to interface with the regulator cap associated with the natural gas meter;

wherein said regulator cap member includes a first portion defining a first aperture complementary to a first regulator cap pattern and said first aperture having a first open side, said regulator cap including a second portion defining a second aperture complementary to a second regulator cap pattern and defining a second open side;

wherein said first portion open side and said second open side have a unitary construction and are proximate said first end of said body member;

wherein said first open side is in fluid communication with said second open side;

wherein said first aperture of said first portion defines a diameter that is different than a diameter defined by said second aperture of said second portion;

wherein said first portion defines a plurality of first slots extending away from said first aperture and each first slot having a dimension for receiving and engaging the plurality of flanges of the regulator cap of the gas meter;

wherein said second portion defines a plurality of second slots extending away from said second aperture and each second slot having a dimension for receiving and engaging the plurality of flanges of the regulator cap of the gas meter;

a service valve member coupled to said second end of said body member and that is configured to interface with a service valve associated with the natural gas meter;

wherein said service valve member includes a bifurcated wrench head coupled to and extending from said second end of said body member and includes a pair of prongs displaced from and parallel to one another so as to engage the service valve of the utility meter, said second end being angularly offset from a longitudinal axis defined by said body member;

a pressure adjustment member coupled to said body member intermediate said first end and said second end, wherein said pressure adjustment member includes a housing having an elongate and cylindrical outer configuration and defining an interior area, said pressure adjustment member having (1) a first open end defining a first pressure adjustment pattern having a fixed and hexagonal-shaped configuration associated with said first regulator cap pattern and having (2) a second open end defining a second pressure adjustment pattern having a fixed and hexagonal-shaped configuration associated with said second regulator cap pattern.

5. The utility tool as in claim 4, wherein:

said body member defines a first bypass aperture adjacent to said first end and having a first orientation;

said body member defines a second bypass aperture having a second orientation that is rotationally offset about 45 degrees relative to said first bypass aperture.

6. The utility tool as in claim 5, wherein said body member includes a third bypass aperture displaced from said first and second bypass apertures.

7. The utility tool as in claim 6, wherein said third bypass aperture is positioned adjacent to said pressure adjustment member and downstream of said pressure adjustment member relative to said first and second pressure bypass apertures.

* * * * *